US005719604A

United States Patent [19]

Inui et al.

[11] Patent Number: 5,719,604

[45] Date of Patent: Feb. 17, 1998

[54] DIAPHRAGM TYPE INK JET HEAD HAVING A HIGH DEGREE OF INTEGRATION AND A HIGH INK DISCHARGE EFFICIENCY

[75] Inventors: Tetsuya Inui, Nara; Hirotsugu Matoba, Sakurai; Susumu Hirata, Ikoma-gun; Yorishige Ishii, Yamatotakada; Shingo Abe, Tenri; Masaharu Kimura, Daitou; Hajime Horinaka, Kashiba; Hiroshi Onda, Yamatokooriyama, all of Japan

[73] Assignee: Sharp Kabushiki Kaisha, Osaka, Japan

[21] Appl. No.: 509,604

[22] Filed: Jul. 31, 1995

[30] Foreign Application Priority Data

Sep. 27, 1994 [JP] Japan ..... 6-231041

[51] Int. Cl.[6] ..... B41J 2/05

[52] U.S. Cl. ..... 347/54; 347/61

[58] Field of Search ..... 347/54, 61

[56] References Cited

U.S. PATENT DOCUMENTS 5,467,112 11/1995 Mitani ..... 347/1

FOREIGN PATENT DOCUMENTS 2-30543 1/1990 Japan .

OTHER PUBLICATIONS

Ser. No. 08/442,701, May 1995, Abe et al.

Ser. No. 08/454,684, May 1995, Hirata et al.

*Primary Examiner*—Daniel P. Malley

*Attorney, Agent, or Firm*—Nixon & Vanderhye P.C.

[57] ABSTRACT

A pressure generating member applies a pressure to an ink, the member having a symmetric configuration and including a buckling body. The buckling body may include a radially extending ribbed portion on its upper surface and no buckling layer beneath it. A heater layer is interposed between insulating layers for heating the buckling body, the buckling body having its peripheral edge portion fixed on a substrate. A center portion of the buckling body is buckled by being heated. An orifice plate is arranged so as to cover the pressure generating member with interposition of a gap defining a cavity for the ink. The orifice plate is provided with a nozzle serving as an ink discharge outlet located in a portion of the orifice plate opposite to the pressure generating member.

20 Claims, 7 Drawing Sheets

DIAPHRAGM TYPE INK JET HEAD HAVING A HIGH DEGREE OF INTEGRATION AND A HIGH INK DISCHARGE EFFICIENCY

BACKGROUND OF THE INVENTION

1. Field of the Invention

The present invention relates to an ink jet printer technique for effecting printing by discharging minute drops of a liquid ink so that the ink drops fly onto a sheet, and more particularly to a head of an ink jet printer.

2. Description of the Prior Art

In recent years, with the advance of computers, printers which serve as output devices of information from the computers have gained in importance. That is, with the downsizing and the advance in performance of computers, printers for printing code data, image data and the like from the computers on a paper sheet or a film for an OHP (Overhead Projector) have been required to achieve further improvements in performances, downsizing and functions thereof. Among those printers, an ink jet printer for printing character data and image data by discharging a liquid ink onto a paper sheet, a polymer film or the like has such advantages that it is capable of being downsized, improving its performance, and reducing its power consumption. Accordingly, there have been made efforts in developing the type of printers in late years.

In a structure of an ink jet printer, the most important part is a component referred to as an ink jet head for discharging ink, and therefore it is important to manufacture such a head compactly at a low cost. Conventionally, several methods have been adopted for the ink jet head. One of the methods uses a piezoelectric device as shown in FIG. 11A, where a high voltage is applied to a piezoelectric device 51 so as to cause a mechanical deformation in the device and consequently generate a pressure in an ink pressure chamber 52 with the mechanical deformation, so that an ink will be discharged in a form of particles from a nozzle 53. Then, as shown in FIG. 11B, the application of high voltage is stopped so as to restore the deformation of the piezoelectric device 51, while sucking ink from a supply inlet 54 into the ink pressure chamber 52.

Another method is referred to as a bubble jet system as shown in FIG. 12, where a heater 56 provided on an internal surface of a lower plate 55 is rapidly heated by flowing an electric current through the heater 56 so as to boil an ink filled in a space between an upper plate 57 and the lower plate 55 thereby generating bubbles, and with a change in pressure caused by the generation of bubbles, the ink is discharged from a nozzle 58 provided at the upper plate 57.

Further, according to a system disclosed in Japanese Patent Laid-Open Publication No. HEI 2-30543, a bimetal device is provided in an ink chamber, and the bimetal device is heated to generate a deformation therein, with which operation a pressure is applied to an ink so as to discharge the ink.

However, according to the first method utilizing a piezoelectric device, it is required to form a piezoelectric device by laminating piezoelectric materials, and thereafter mechanically processing the resulting piezoelectric laminate in producing a head. According to the mechanical processing, an interval between ink chambers cannot be sufficiently reduced, also resulting in a problem that an interval between nozzle for discharging the ink cannot be reduced.

In the second case of the bubble jet system, it is required to instantaneously heat the heater up to a high temperature of several hundred degrees centigrade in order to boil the ink to make it generate bubbles. Therefore, deterioration of the heater cannot be suppressed, also resulting in a problem that the device has a reduced operating life.

In the third case of the system disclosed in Japanese Patent Laid-Open Publication No. HEI 2-30543, the bimetal that is formed by sticking together different sorts of materials and made to serve as a drive source for discharging the ink is heated so as to generate a deformation therein, with which operation the ink is discharged. In this case, it is required to form a bimetal structure in which different sorts of materials are stuck together as the drive source, and this results in a problem of a complicated structure. Furthermore, it is required to collectively produce a lot of minute drive source components for the production of the drive source, on the occasion the drive source components are required to be individually produced and then assembled, also resulting in a problem that the integration of the components difficult.

SUMMARY OF THE INVENTION

The present invention has been developed with a view to substantially solving the above described disadvantages and has for its essential object to provide an ink jet head having a high degree of integration and a high ink discharging efficiency.

In order to achieve the aforementioned object, there is provided an ink jet head comprising: an orifice plate provided on a substrate and including a section spaced from the substrate from the substrate defining a cavity; pressure generating structure comprised of a buckling body having a configuration symmetrical about a center point thereof, in which a peripheral edge portion of the buckling body is fixed to the substrate inside the cavity, and the buckled body is buckledly deformed by being heated to generate a pressure for discharging the ink; and a nozzle communicating with the cavity and operates to discharge the ink.

According to the ink jet head, the buckling body which has a configuration symmetrical about a center point thereof and has its peripheral edge portion fixed to the substrate is buckled by being heated, so that it applies a pressure to the ink filled in the cavity. The ink to which a pressure is applied is discharged outwardly from the nozzle communicated with the cavity in a form of ink drops, thereby effecting printing on a recording paper sheet or the like. The buckling body of the pressure generating structure restores its deformed shape to the original shape when the heating is stopped, and with the restoration, new ink is sucked into the cavity. In this case, the pressure generating structure is comprised of the buckling body of which peripheral edge portion symmetrical about the point is fixed to the substrate, and has a structure for applying a pressure directly to the ink. Therefore, the generating structure is deformed greatly in a direction perpendicular to a surface thereof even when it has a small area, and is able to apply a great pressure to the ink without leaking the ink, thereby allowing an increased ink discharging efficiency to be achieved. Furthermore, unlike the systems of the prior arts, the interval between nozzles can be reduced with a simple structure, and integration of components can be easily achieved while suppressing the deterioration of the heater.

Also, there is provided an ink jet head comprising: an orifice plate provided on a substrate and including a section spaced from substrate defining a cavity pressure generating structure comprised of a buckling body which has a configuration symmetrical about a center point thereof and has a radially extending ribbed portion on its upper surface and no buckling layer beneath it, in which a peripheral edge portion of the buckling body is fixed to the substrate inside the cavity, and a center portion of the buckling body is buckled by being heated to generate a pressure for discharging the ink; and a nozzle located in a position opposite to the pressure generating structure at a member constituting an upper portion of the cavity.

According to the ink jet head, the radially extending ribbed portion having no buckling layer beneath it is provided on the upper surface of the first pressure generating structure. Therefore, when the buckling body is buckled by being heated, the flexible ribbed portion is deformed while warping at both sides thereof symmetrically about its longitudinal center plane within its transverse sectional plane. Therefore, a compressive stress generated in a circumferential direction in the pressure generating structure is absorbed to be relieved, so that the buckling body can be easily buckled advantageously.

In an embodiment in which the ribbed portion has a convex or concave configuration, the stiffness of the ribbed portion is further reduced to promote the effects of absorption and relief of the compressive stress, so that the amount of buckling deformation of the pressure generating structure and, in its turn, the ink discharging efficiency can be increased.

Furthermore, in an embodiment in which the ribbed portion is a concave type having a cut portion at a projecting portion between adjacent recess portions thereof, and one end portion of the cut portion laps over the buckling body with interposition of a gap, the compressive stress generated in the circumferential direction is released by the cut portion, thereby allowing the buckling body to buckle more easily. Furthermore, the gap beneath the cut portion is closed in a direction in which it abuts against the buckling body upon receiving a pressure from the ink inside the cavity when the ink is discharged, thereby eliminating the possibility of leak of the ink and allowing the amount of buckling deformation of the pressure generating structure and, in its turn, the ink discharging efficiency to be further increased.

Further, there is provided an ink jet head comprising: a substrate; pressure generating structure comprised of a buckling body which has a configuration symmetrical about a center point thereof and has a radially extending ribbed portion on its upper surface and no buckling layer beneath it, and a heater section for heating the buckling body, in which a peripheral edge portion of the buckling body is fixed on the substrate, and a center portion of the buckling body is buckled by being heated; an orifice plate arranged above the pressure generating structure so as to cover the pressure generating structure with interposition of a gap, in which a space between the orifice plate and one side edge portion of the buckling body is sealed by a spacer layer, and an ink supply path is formed between the orifice plate and the other side edge portion of the buckling body, thereby making the gap serve as a cavity; and a nozzle which is provided as an ink discharge outlet and located in a position of the orifice plate opposite to a center portion of the pressure generating structure.

According to the ink jet head, the second pressure generating structure is comprised of the buckling body and the heater section for heating the buckling body. Therefore, only the heater section is heated by flowing a current smaller than in the case where the buckling body is buckled by flowing an electric current through the buckling body itself, while allowing the same amount of buckling deformation to be obtained and allowing a power source and, in its turn, the ink jet head to be compacted.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will be described in detail based on several embodiments thereof with reference to the accompanying drawings.

Figure 1:
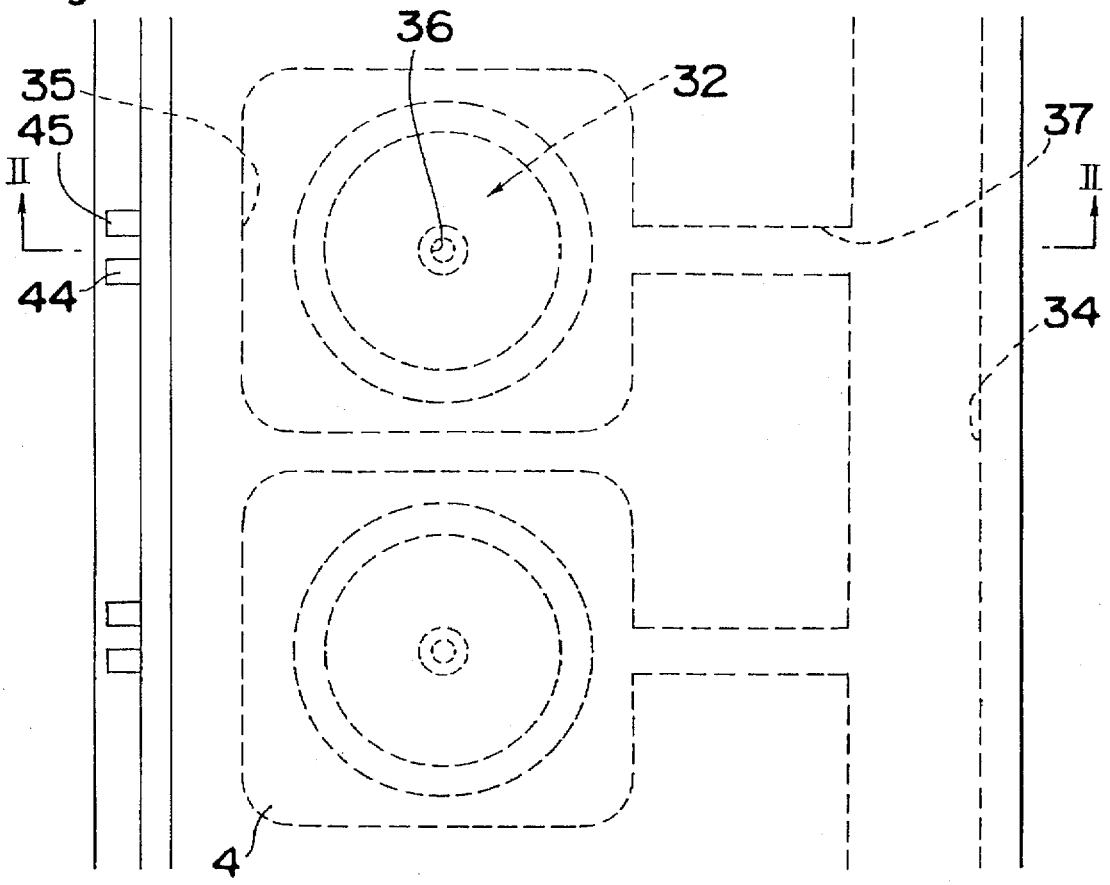
FIG. 1 is a plan view showing an embodiment of an ink jet head according to a first aspect of the present invention.
Figure 2:
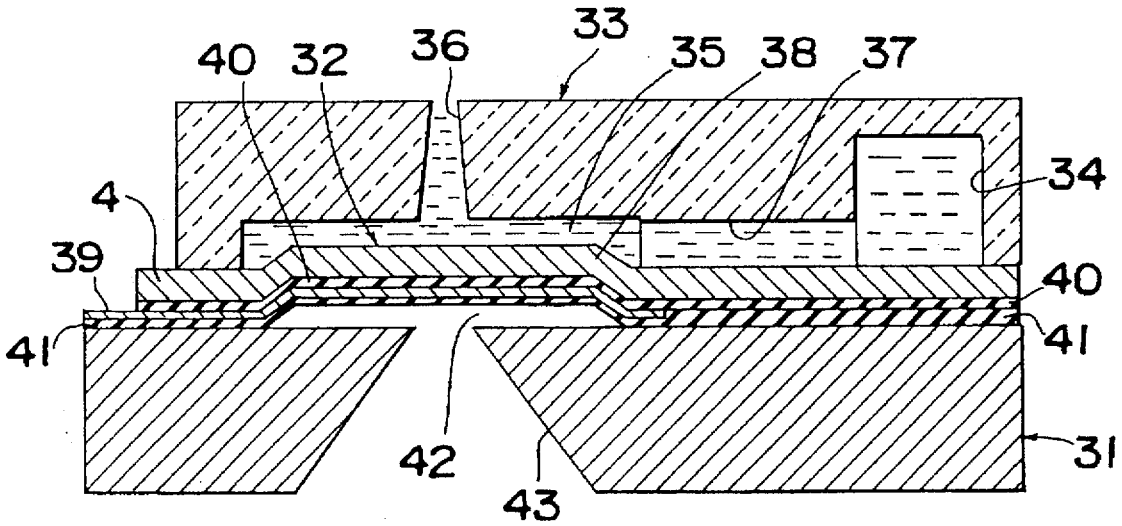
FIG. 2 is a sectional view of the embodiment shown in FIG. 1.

FIGS. 1 and 2 are respectively a plan view and a sectional view of an ink jet head according to an embodiment of the first aspect of the present invention. This ink jet head comprises: a substrate 31; pressure generating structure 32 which has a circular configuration and has its peripheral edge portion fixed to the substrate 31, and in which a center portion thereof is buckled in a direction perpendicular to the substrate by being heated; and an orifice plate 33. This orifice plate 33 is arranged above the pressure generating structure 32 with interposition of a gap, wherein an ink reservoir 34 is formed along one longitudinal edge, surrounding walls are abuttedly fixed to the pressure generating structure 32 so as to form a cavity serving as an ink chamber 35 over each pressure generating structure 32, a nozzle 36 serving as an ink discharge outlet is formed in a position opposite to a center portion of the pressure generating structure, and an ink supply path 37 enabling the ink chamber 35 to communicate with the ink reservoir 34 is formed.

The pressure generating structure 32 is comprised of a buckling body 38 and a heater layer 39 which is provided beneath the buckling body 38 as interposed between insulating layers 40 and 41. The heater layer 39 and the substrate 31 are separated from each other, and a gap 42 communicated with a tapered fluid supply inlet 43 which penetrates the substrate 31 exists therebetween. The heater layer 39 is so formed as to have a pattern appropriate for uniformly heating the buckling body 38, and its both ends are used as electricity supply pads 44 and 45 exposed to the outside. The ink jet head of the present embodiment has approximately the same structure as that of other embodiment described hereinafter except that no radially extending ribbed portion exists on an upper surface of the buckling body 38 of the pressure generating structure 32. Therefore, no description is provided for the manufacturing method and operation of each component.

It is acceptable to eliminate the heater layer 39 of the above-mentioned embodiment and directly supply electricity to the buckling body so as to heat the buckling body thereby causing the same to be buckled. Although the pressure generating structure 32 has a circular configuration in the above-mentioned embodiment, it may have an arbitrary symmetrical configuration symmetrical about a center point thereof including a polygon such as a hexagon or an octagon. It is to be noted that the pressure generating structure is not allowed to have a rectangular configuration which is not symmetrical about the center thereof because the shorter side of a rectangle is deformed less than the longer side of the rectangle, resulting in a larger stress in the direction of the shorter side. Therefore, a degree of deformation depends substantially on the dimension in the direction of the shorter side, and the longer side has a lot of portions that are not deformed, the portions being substantially wasteful.

Figure 3:
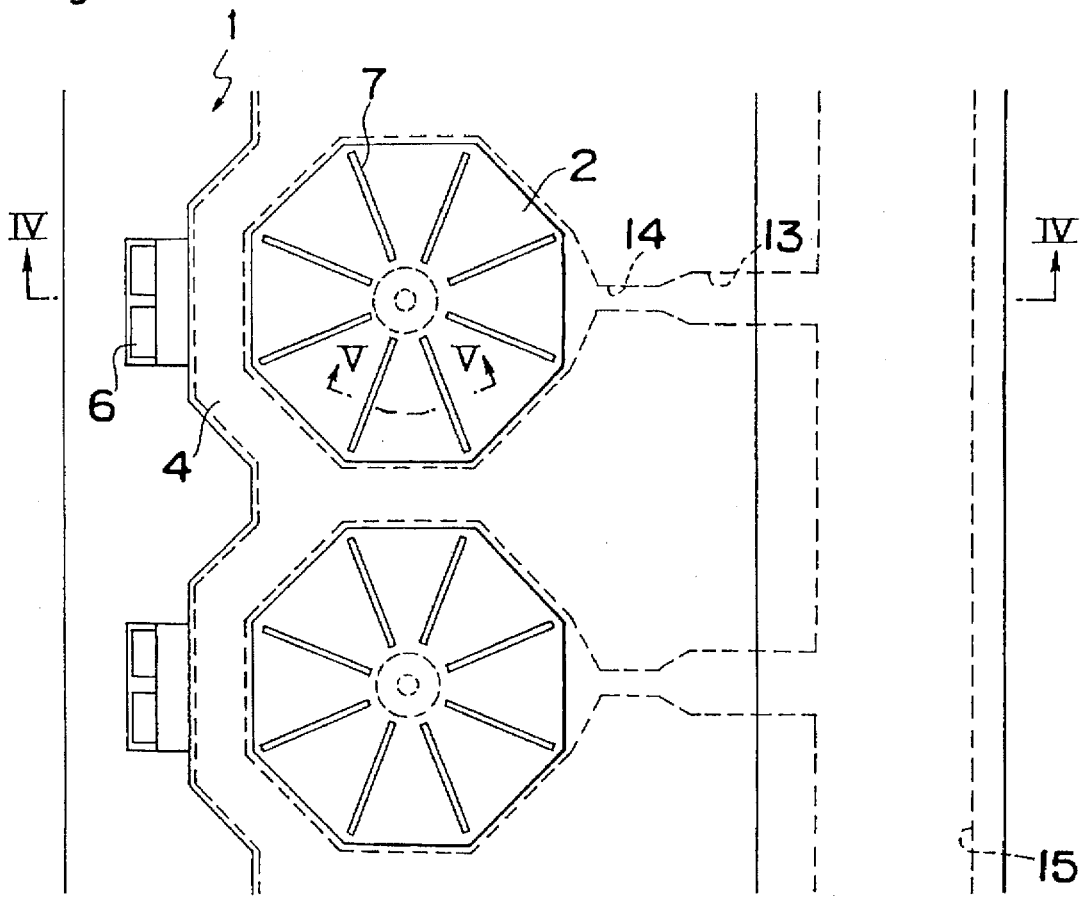
FIG. 3 is a plan view showing an embodiment of an ink jet head according to second and third aspects of the present invention.
Figure 4:
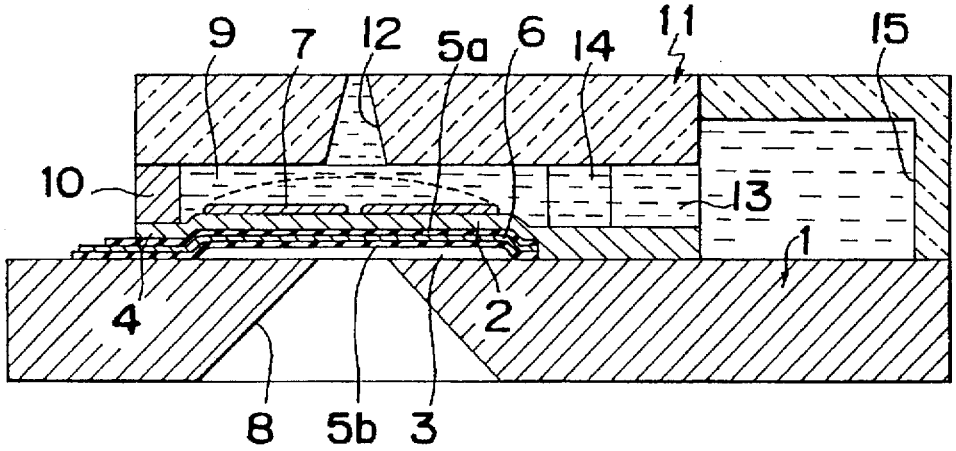
FIG. 4 is a sectional view taken along a line IV—IV in FIG. 3.

FIG. 3 shows a plan view showing an embodiment of an actuator section of an ink jet head according to the second and third aspects of the present invention, where a plurality of actuators are formed on a substrate 1. FIG. 4 shows a sectional view taken along a line IV—IV in FIG. 3, where a buckling body 2 is provided on the substrate 1 via a gap 3. A peripheral edge portion 4 of the buckling body 2 is fixed to the substrate 1, and a center portion thereof is put in a state in which it is fixed to nothing, i.e., freely set apart from the substrate 1 via the gap. Beneath the buckling body 2 is formed a heater layer 6 as interposed between insulating layers **5*a* and 5*b*. The heater layer 6 can be arranged in a form of a pattern (not shown) appropriate for the buckling body 2 so as to uniformly heat the buckling body 2. Although the heater layer 6 is provided beneath the buckling body 2, the present invention is not limited to this, and it is acceptable to adopt a method of heating the buckling body 2 by directly supplying an electricity thereto. At the substrate 1 is provided a fluid supply inlet 8 which penetrates through the substrate 1**.

The buckling body 2 is so formed as to have a single film-like shape having an approximately octagonal configuration in the plan view. It is to be noted that the buckling body 2 is not required to have an octagonal configuration, and it may have any configuration symmetrical about a center thereof such as a square, pentagonal or hexagonal configuration. The device is to be entirely deformed in a dome shape by buckling as described hereinafter. Therefore, a configuration symmetrical about the center thereof is more advantageous because it causes no unbalance in internal stress. If the configuration is a rectangular one, the shorter side of the rectangle is deformed less than the longer side of the rectangle, resulting in a larger stress in the direction of the shorter side. Therefore, the degree of deformation depends substantially on the dimension in the direction of the shorter side, and the longer side has a lot of portions that are not deformed, the portions being substantially wasteful.

Figure 5:
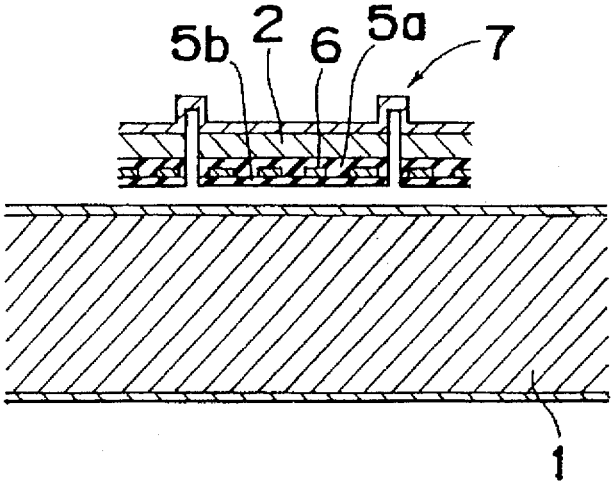
FIG. 5 is a sectional view taken along a line V—V in FIG. 3.

The buckling body 2 has a plurality of ribbed portions 7 extending from the center thereof towards the periphery. FIG. 5 shows a sectional view taken along a line V—V in FIG. 3, showing the ribbed portion 7. The ribbed portion 7 has no layer of the buckling body 2 beneath it, consequently having a small thickness and hat shaped cross section. The ribbed portion 7 and the buckling body 2 are firmly fixed to each other to be integrated, totally having a single-layer film-like structure.

Further, as shown in FIG. 4, a cavity 9 for ink, a spacer layer 10, and an orifice plate 11 are provided, and the orifice plate 11 is provided with a nozzle 12. In the spacer layer 10 is provided an ink supply path 13 which is connected to an ink reservoir 15 having greater dimensions. The ink supply path 13 is partially provided with a narrow portion 14.

The ink jet head having the above-mentioned construction operates in a manner as follows.

In the ink jet head, the gap 3 and the cavity 9 are preparatorily filled with an ink in operation. The gap 3 may be filled with a liquid such as water, silicone oil, alcohol or other macromolecular liquid other than the ink. Then, the heater layer 6 generates heat due to Joule heat upon receiving a current flowing therethrough. With the generation of heat, the buckling body 2 expands, however, it cannot expand since the peripheral edge portion 4 thereof is fixed to the substrate 1. Consequently, a compressive stress is generated in the radial direction inside the buckling body 2. When the buckling body 2 is heated by the current flowing therethrough until the compressive stress exceeds a specified magnitude, the buckling body 2 starts to buckle, and eventually deformed in a dome shape in a direction perpendicular to the substrate 1 as indicated by dotted lines in FIG. 4. In the above stage, the ribbed portions 7 absorb and relieve the compressive stress in the circumferential direction, and therefore buckling tends to occur. Then, because of a change in volume due to the buckling, an internal pressure of the cavity 9 is increased, so that the ink is discharged from the nozzle 12 to effect printing. When the current is cut off, the buckling body 2 radiates the heat to the substrate 1 and the orifice plate 11 through the gap 3 filled with the ink and the cavity 9. Therefore, as the temperature reduces, the buckling disappears and then the deformation is restored. With the restoration, the ink is supplied from the ink supply path 13, and the cavity 9 is again filled with ink so as to be ready for a subsequent discharging operation.

FIGS. 6A through 6E are views showing a manufacturing method of the actuator section of the ink jet head described with reference to FIG. 3.

Figure 6D:
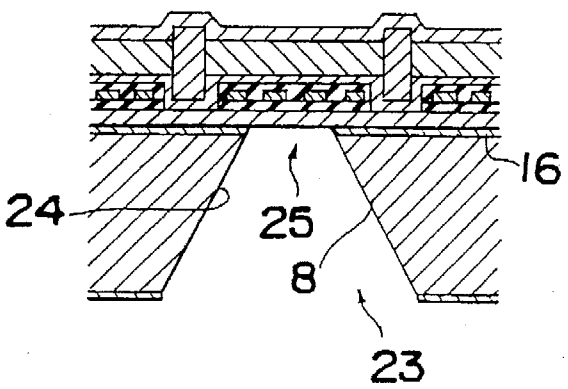
FIGS. 6A through 6E are views showing a manufacturing method of the embodiment shown in FIG. 3.
Figure 6E:
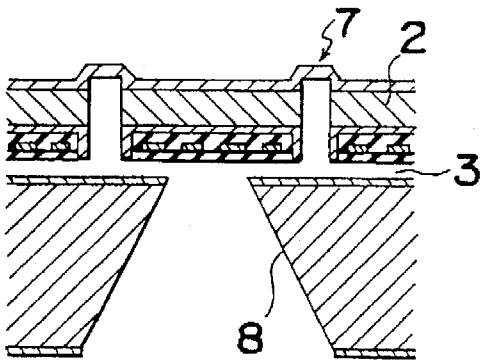
Figure 6C:
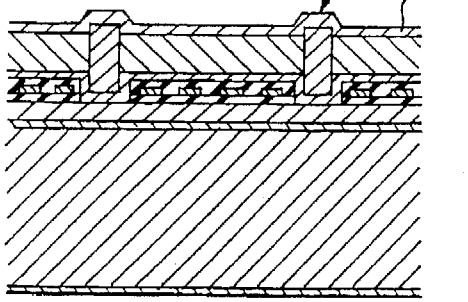
Figure 6A:
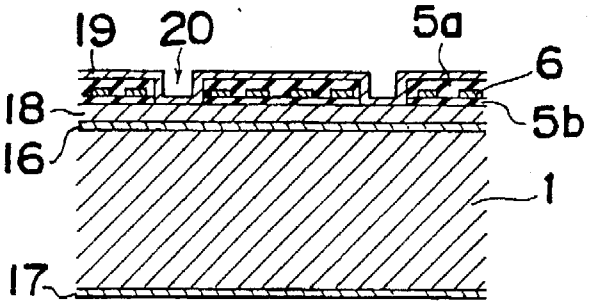

First, as shown in FIG. 6A, thermal oxidation films 16 and 17 are formed on both surfaces of the silicon monocrystal substrate 1, and then a sacrifice layer 18 is formed on the thermal oxidation film 16. As a material for the sacrifice layer 18, there can be used any of the materials of aluminum, photoresist, polyimide resin and so forth. In particular, taking into account the fact that the sacrifice layer will be removed in a subsequent process, the material of aluminum which can be easily removed by acid or alkali is preferable. Then, an electric insulating film **5*b* is formed by a photolithographic technique while providing a gap 20 corresponding to a ribbed portion to be formed afterwards. Subsequently, a heater layer 6 is laminated, and further an electric insulating film 5*a* is formed thereon so as to cover the heater layer 6. As a material for the electric insulating films 5, there can be used any of the materials of silicon oxide, silicon dioxide, silicon nitride, aluminum nitride and aluminum oxide. As a material for the heater layer 6, there can be used any of the materials of nickel, chromium, tantalum, molybdenum, hafnium, boron, alloys thereof and compounds thereof. Further, a metal substrate film 19 is formed on the entire surface. The metal substrate film 19 is provided as an electrode for the subsequent process of plating, and is capable of being formed of any of the materials of nickel, chromium, cobalt and aluminum, the material being preferably the same material as that of a buckling body 2** to be formed subsequently.

Figure 6B:
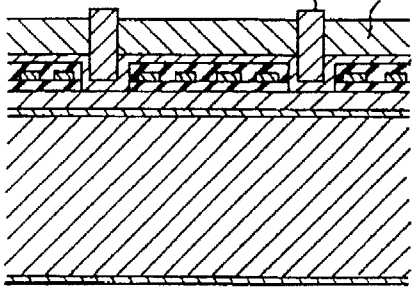

Then, as shown in FIG. 6B, a photoresist layer 21 is formed in the gap 20 opened preparatorily. Thereafter, electric plating is effected to form a buckling body 2. As a material for the buckling body 2, there can be used any of the materials of nickel, chromium, cobalt, copper and alloys thereof. A thickness of the plating of the buckling body 2 is set lower than a height of the photoresist layer 21. A difference in height between the buckling body 2 and the photoresist layer 21 is set to about 0.1 to 10 μm.

Then, as shown in FIG. 6C, a plating film 22 is formed on the entire surface. The plating film 22 is basically made of the same material as that of the buckling body 2, however, it may be made of a different material. In the present case, since the height of the buckling body 2 is set lower than the height of the resist layer 21, the plating film 22 is formed with a ribbed thickness A thickness of the plating film 22 is preferably set smaller than the thickness of the buckling body 2, and it is preferably set within a range of 0.1 to 5 μm.

Subsequently, as shown in FIG. 6D, an opening portion 23 is provided through the thermal oxidation film 17 on the rear surface, and a fluid supply inlet 8 is formed by etching. The formation of the fluid supply inlet 8 can be effected by anisotropic etching with a KOH solution. When a (100)-face monocrystal is used for the substrate 1, because of a slow (111)-face etching velocity, a (111)-face 24 is left, so that the fluid supply inlet is formed. Thereafter, an opening 25 is provided through the thermal oxidation film 16 by ion milling.

Subsequently, the sacrifice layer 18 is removed. For the removal, heated phosphoric acid is selected when aluminum is used as the sacrifice layer, or a specified liquid such as a remover liquid is selected when a resist is used as the sacrifice layer. Thereafter, the metal film 19 beneath the resist layer 21 is removed. The removal can be performed by using nitric acid when nickel is used as the metal film 19. In the above-mentioned case, there is the danger that the buckling body 2 is also corroded by the nitric acid, however, by performing the process in a short time with a diluted nitric acid solution, no substantial damage arises in the other portions. Thereafter, the resist layer 21 is removed. The removal of the above-mentioned films are all effected through the fluid supply inlet 8. Thus, as shown in FIG. 6E, an actuator for an ink jet head having the fluid supply inlet 8, the gap 3 and the ribbed portion 7 is constructed.

Thereafter, the orifice plate 11 provided with the nozzle 12 and the ink reservoir 15 are attached to the above-mentioned actuator, so that an ink jet head as shown in FIG. 4 is completed.

Figure 7:
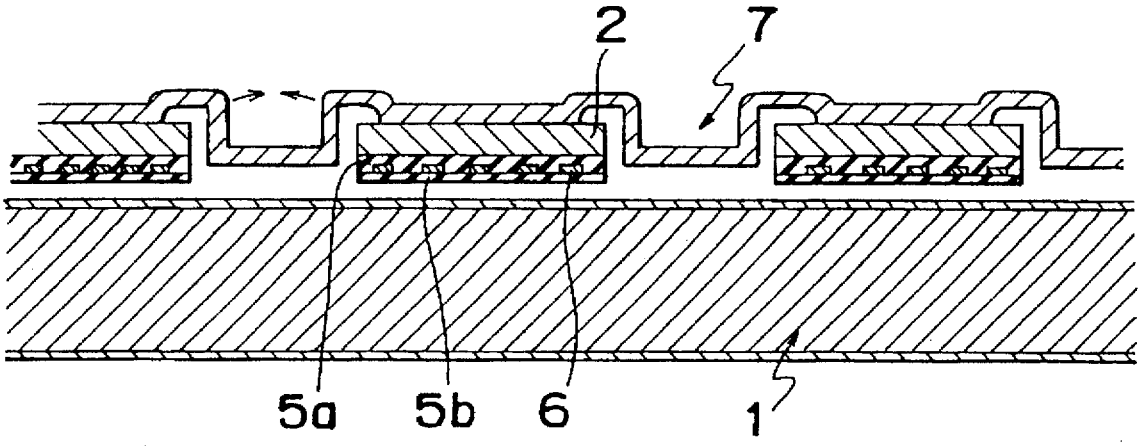
FIG. 7 is a sectional view showing an embodiment of an ink jet head according to the second aspect of the present invention.

FIG. 7 shows an ink jet head according to an embodiment of the second aspect of the present invention. This embodiment has a ribbed portion 7 different from that of the embodiment described with reference to FIG. 3. In this embodiment, there are included a heater circuit 6 interposed between insulating films **5*a* and 5*b* on a silicon substrate 1 and a buckling body 2 provided thereon, and those members are connected with each other via the ribbed portion 7. The ribbed portion 7 has a concave on reverse-hat shaped cross section, where a compressive stress generated in the buckling body 2 in the circumferential direction (in the right and left direction in FIG. 7) when the buckling body 2 is buckled is relieved by a bending motion (in the directions of arrows in FIG. 7) of vertical walls of the ribbed portion 7**.

The ink head actuator of the present embodiment is manufactured in a manner as follows.

Figure 8E:
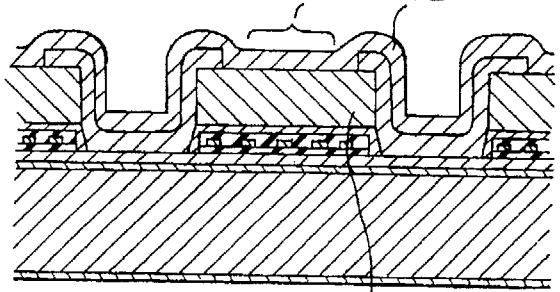
FIGS. 8A through 8F are views showing a manufacturing method of the embodiment shown in FIG. 7.
Figure 8F:
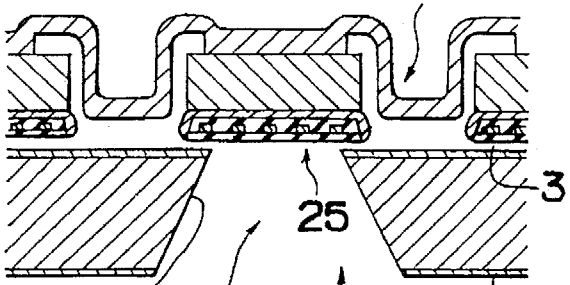
Figure 8D:
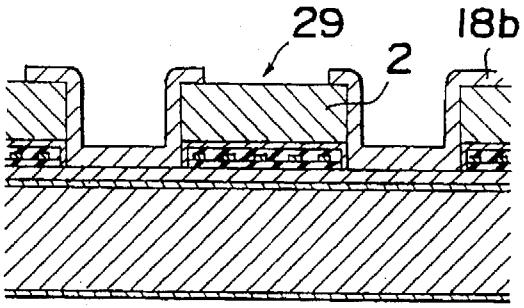
Figure 8A:
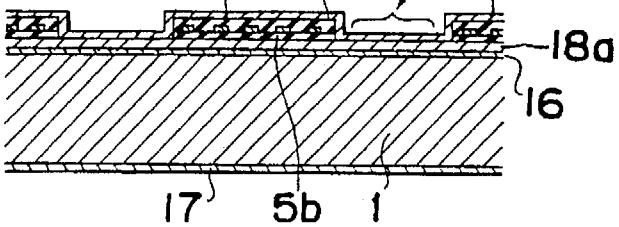

First, as shown in FIG. 8A, thermal oxidation films 16 and 17 are formed on both surfaces of the silicon monocrystal substrate 1, and a sacrifice layer **18*a* is formed on the thermal oxidation film 16. As a material for the sacrifice layer 18*a*, there can be used any of the materials of aluminum, photoresist, polyimide resin and so forth. In particular, taking into account the fact that the sacrifice layer will be removed in a subsequent process, the material of aluminum which can be easily removed by acid or alkali is preferable. Then, an electric insulating film 5*b* is formed by a photolithographic technique while providing a gap 20 corresponding to a ribbed to be formed afterwards. Then, a heater layer 6 is laminated, and further an electric insulating film 5*a* is formed thereon so as to cover the heater layer 6. As a material for the electric insulating films 5, there can be used any of the materials of silicon oxide, silicon dioxide, silicon nitride, aluminum nitride and aluminum oxide. As a material for the heater layer 6, there can be used any of the materials of nickel, chromium, tantalum, molybdenum, hafnium, boron, alloys thereof and compounds thereof. Further, a metal substrate film 19 is formed on the entire surface. The metal substrate film 19 is provided as an electrode for the subsequent process of plating, and is capable of being formed of any of the materials of nickel, chromium, cobalt and aluminum, the material being preferably the same material as that of a buckling body 2** to be formed subsequently.

Figure 8B:
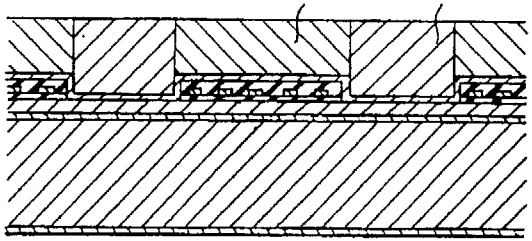

Then, as shown in FIG. 8B, a photoresist layer 21 is formed in the gap 20 opened preparatorily, and a photoresist layer 21 is formed by the photolithographic technique just in the width of the gap 20. Thereafter, electric plating is effected to form a buckling body 2. As a material for the buckling body 2, there can be used any of the materials of nickel, chromium, cobalt, copper and alloys thereof. When electric plating is effected, the buckling body 2 forms in a portion where the resist pattern 21 is missing existing (in the present case, on the portion where the heater 6 and the insulating films 5 are existing).

Figure 8C:
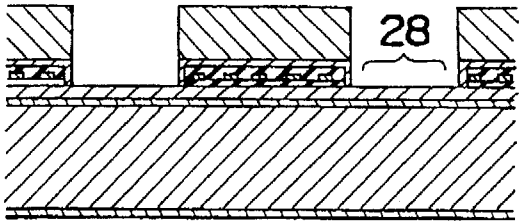

Then, as shown in FIG. 8C, the resist 21 is removed, and the metal substrate film 19 located in a portion beneath the resist pattern (a portion in the gap 20) is further removed. The removal process can be effected by an ion milling or etching method. When the removal process is effected, the metal substrate film 19 in a portion 28 beneath the resist pattern 21 is removed, so that the sacrifice layer **18*a* beneath the film 19** is exposed.

Then, the substrate 1 is processed with plating, thereby forming a sacrifice layer film **18*b*. In this stage, the film expands over side wall portions of the buckling body 2 having a great difference in level, thereby allowing the film to be formed on the entire surface. In the present invention, the buckling body 2 and the sacrifice layer 18 are each made of a metal material having a conductivity, and therefore the plating can be easily effected without performing any specific process for giving a conductivity. As a material for the sacrifice layer 18*b*, zinc or tin can be used. In particular, zinc can be easily plated and easily etched by acid or alkali, and therefore the sacrifice layer of zinc is advantageous for removing afterwards. Thereafter, as shown in FIG. 8D, an opening portion 29 is provided by a lithographic technique at the plated portion corresponding to a center portion of the buckling body 2. The opening portion 29** can be formed by etching after a resist pattern is formed.

Then, as shown in FIG. 8E, a metal film 30 is formed on the entire surface. The metal film 30 is preferably formed by plating. As its material, it is preferable to use the same material as that of the buckling body 2, since a portion 24 to be formed at the opening portion 29 is firmly combined with the buckling body 2 advantageously.

Subsequently, an opening portion 23 is provided through the thermal oxidation film 17 on the rear surface of the substrate 1, and a fluid supply inlet 8 is formed by etching. The formation of the fluid supply inlet 8 can be effected by anisotropic etching with KOH solution. When a (100)-face monocrystal is used for the substrate 1, because of a slow (111)-face etching velocity, a (111)-face 24 is left, so that the fluid supply inlet 8 is formed. Thereafter, an opening 25 is provided at the thermal oxidation film 16 by ion milling.

Subsequently, the sacrifice layers 18*a* and 18*b* are removed. For the removal, there can be used an etchant such as acid, alkali or organic solvent (depending on the sacrifice layer material). The etchant intrudes from the rear opening 25 and removes the sacrifice layers 18*a* and 18*b* by etching. In the present case, by using aluminum for the sacrifice layer 18*a* and using zinc for the sacrifice layer 18*b*, they can be easily removed by acid or alkali. Thus, as shown in FIG. 8F, an actuator for an ink jet head having the fluid supply inlet 8, the gap 3 and the ribbed portion 7 is formed.

According to the above-mentioned manufacturing method, the metal-plated sacrifice layer is used in forming the ribbed portion, and therefore the sacrifice layer can be removed more easily than the sacrifice layer using the photoresist of the embodiment described with reference to FIG. 3. The above is because the photoresist is possibly deformed if a process effected at a high temperature exists, however, the metal layer does not change its properties, and further metal, particularly aluminum and zinc are easily dissolved in acid and alkali, therefore facilitating easy removal of even a sacrifice layer formed in a narrow gap. For the above-mentioned reasons, there can be achieved a process having a higher stability and assuring a higher yield than in the embodiment described with reference to FIG. 3.

Figure 9:
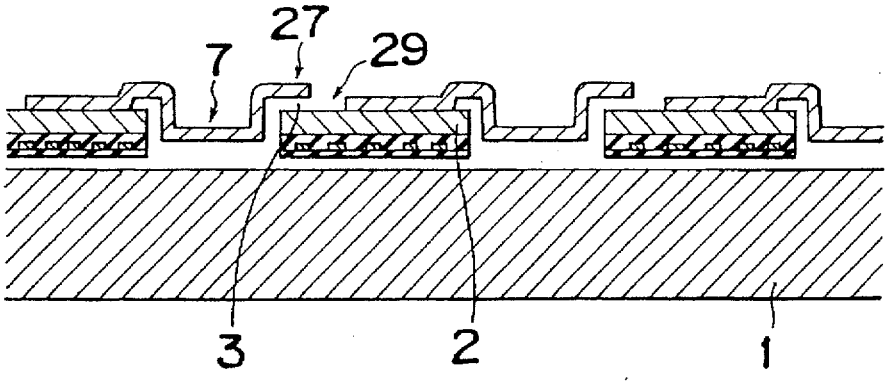
FIG. 9 is a sectional view showing an embodiment of an ink jet head according to the second aspect of the present invention.
Figure 10A:
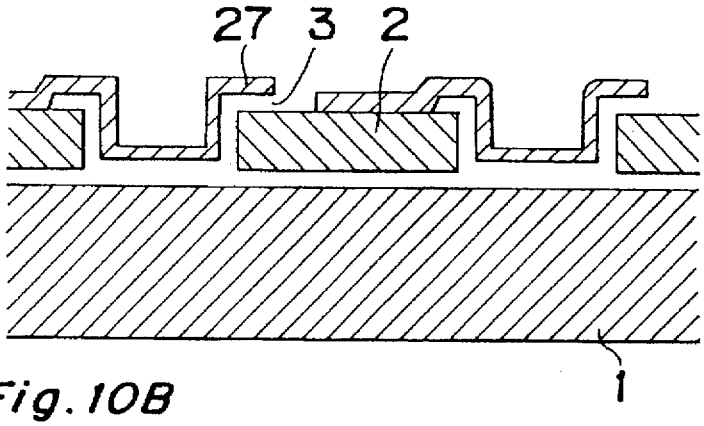
FIGS. 10A and 10B are views for explaining an operation of the embodiment shown in FIG. 9.
Figure 10B:
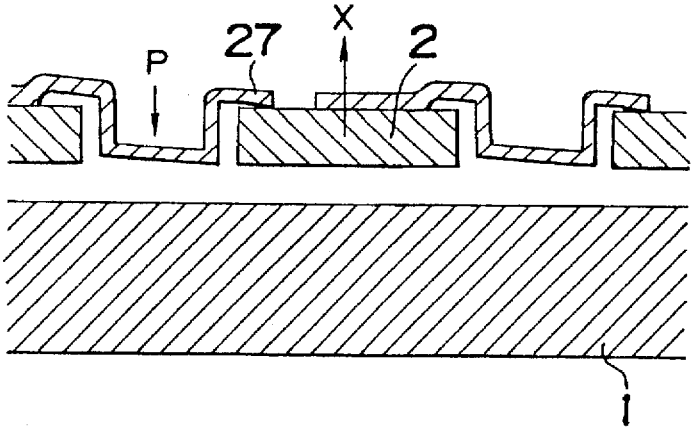
Figure 11A:
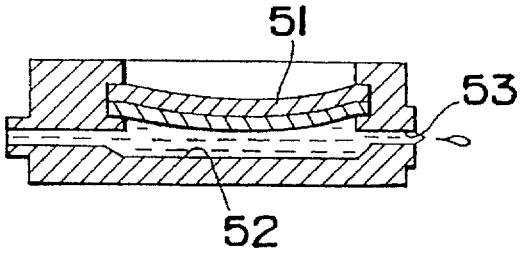
Fig.11A PRIOR ART
FIGS. 11A and 11B are schematic sectional views of a prior art ink jet head employing a piezoelectric device.
Figure 11B:
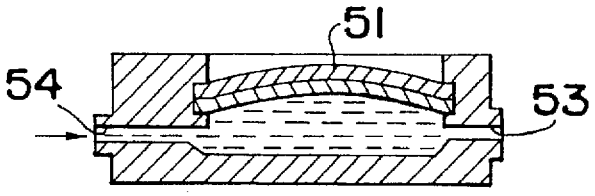
Fig.11B PRIOR ART
Figure 12:
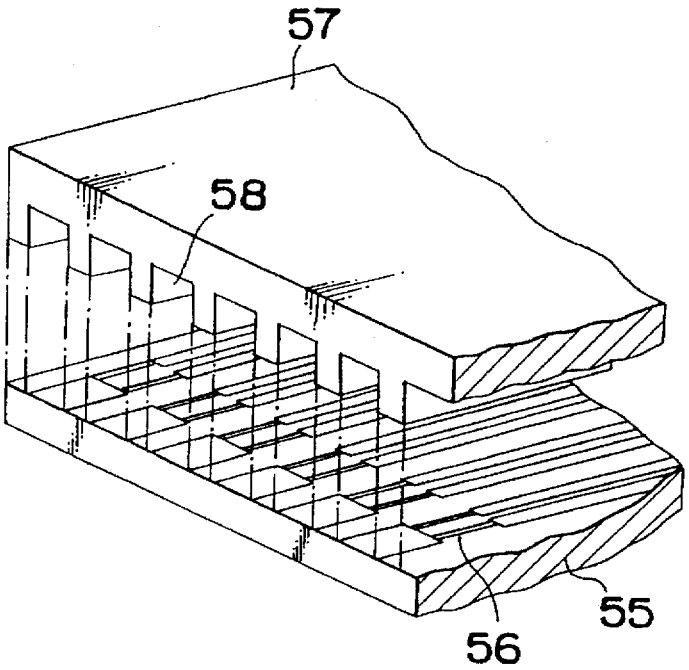
Fig.12 PRIOR ART
FIG. 12 is a schematic perspective view of a prior art bubble jet type ink jet head.

FIG. 9 shows an ink jet head according to an embodiment of the second aspect of the present invention. This embodiment also has a ribbed portion 7 different from that of the embodiment shown in FIG. 3. In this embodiment, a ribbed portion 7 having a concave cross section has a slit-like cut portion 29 at a projecting portion between mutually adjacent recess portions, and a left end portion 27 of the cut portion 29 laps over the buckling body 2 with interposition of a gap 3. That is, buckling bodies are not connected with each other via the ribbed portion 7 but separated at the cut portion 29 provided there. With the above-mentioned arrangement, a compressive stress generated in the buckling bodies 2 in the circumferential direction is released, so that the buckling easily occurs. FIG. 10B shows a state in which the buckling body 2 is buckled to be deformed in a direction perpendicular to the substrate 1, so that it applies a pressure to the cavity 9. When the buckling body 2 is not buckled, as shown in FIG. 10A, the gap 3 is opened between the left end portion 27 at the cut portion and the buckling body 2. When the buckling body 2 is buckled upward in a direction indicated by an arrow X as shown in FIG. 10B, the left end portion 27 is deformed downward by an ink pressure P generated above the buckling body 2 to consequently close the gap 3. Therefore, when the buckling body 2 is buckled, the gap 3 is closed to prevent the ink in the cavity 9 from flowing underneath the buckling body, so that both the effect of promoting the buckling by virtue of the release of the compressive stress in the circumferential direction and the effect of increasing the pressure application efficiency can be concurrently obtained.

According to the construction of the present invention, for the actuator section of the ink jet head, the pressure generating structure that buckles by being heated is produced by a photoetching or plating technique. Accordingly, there can be achieved integration of the components with a compact and simple construction as well as integrate formation of a plurality of heads.

Furthermore, by constructing the buckling body in a single film form, the application of pressure inside the cavity can be performed efficiently without leaking the ink. Furthermore, by making the buckling body have a configuration symmetrical about the center thereof, a stress distribution can be uniformed throughout the entire surface of the buckling body, so that a fatigue load of the buckling body is reduced to allow an ink jet head having a long operating life to be constructed. Furthermore, by virtue of the ribbed portion formed on the buckling body, a compressive stress generated in the circumferential direction can be relieved, thereby allowing a displacement of buckling to be increased. Therefore, the ink discharging efficiency of the ink jet head can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A diaphragm type ink jet head comprising:

an orifice plate provided on a substrate and including a section spaced from said substrate defining a cavity;

pressure generating structure comprised of a buckling body having a configuration symmetrical about a center point of said buckling body, wherein a peripheral edge portion of the buckling body is fixed to said substrate inside said cavity, and wherein the buckling body is buckled by being heated to generate a pressure in said cavity; and a nozzle communicating with said cavity.

2. A diaphragm type ink jet head as claimed in claim 1, wherein the buckling body is one of circular, pentagonal, hexagonal, octagonal, or square.

3. A diaphragm type ink jet head as claimed in claim 1, wherein the buckling body comprises a polygonal shape.

4. A diaphragm type ink jet head as claimed in claim 1, further comprising a heater layer coupled with a side of said buckling body opposite from said nozzle.

5. A diaphragm type ink jet head as claimed in claim 4, wherein said heater layer is formed in a predetermined pattern appropriate for uniformly heating the buckling body.

6. A diaphragm type ink jet head as claimed in claim 1, further comprising a supply of electricity coupled with the buckling body, said electricity supply heating the buckling body.

7. A diaphragm type ink jet head comprising:

an orifice plate provided on a substrate and including a section spaced from said substrate defining a cavity;

pressure generating structure comprised of a buckling body having a configuration symmetrical about a center point of said buckling body and having a radially extending ribbed portion on an upper surface, wherein a peripheral edge portion of the buckling body is fixed to said substrate inside said cavity, and wherein a center portion of the buckling body is buckled by being heated to generate a pressure in said cavity; and a nozzle located in a position opposite to the pressure generating structure and formed in said orifice plate.

8. A diaphragm type ink jet head as claimed in claim 7, wherein an area adjacent said ribbed portion is void of the buckling body.

9. A diaphragm type ink jet head as claimed in claim 7, wherein the buckling body is one of circular, pentagonal, hexagonal, octagonal, or square.

10. A diaphragm type ink jet head as claimed in claim 7, wherein the buckling body comprises a polygonal shape.

11. A diaphragm type ink jet head as claimed in claim 7, further comprising a heater layer coupled with a side of said buckling body opposite from said nozzle.

12. A diaphragm type ink jet head as claimed in claim 11, wherein said heater layer is formed in a predetermined pattern appropriate for uniformly heating the buckling body.

13. A diaphragm type ink jet head as claimed in claim 7, further comprising a supply of electricity coupled with the buckling body, said electricity supply heating the buckling body.

14. A diaphragm type ink jet head as claimed in claim 7, wherein the ribbed portion of the pressure generating structure has a convex configuration.

15. A diaphragm type ink jet head as claimed in claim 7, wherein the ribbed portion of the pressure generating structure has a concave configuration.

16. A diaphragm type ink jet head as claimed in claim 15, wherein the ribbed portion of the pressure generating structure has a cut portion at a projecting portion between adjacent recess portions thereof, and one end portion of the cut portion laps over the buckling body with interposition of a gap.

17. A diaphragm type ink jet head comprising:

a substrate;

pressure generating structure comprised of a buckling body having a configuration symmetrical about a center point of said buckling body and having a radially extending ribbed portion on an upper surface and a heater section for heating the buckling body, wherein a peripheral edge portion of the buckling body is fixed to said substrate, and wherein a center portion of the buckling body is buckled by being heated;

an orifice plate including a section spaced from the pressure generating structure so as to cover the pressure generating structure with interposition of a gap, wherein a space between the orifice plate and one side edge portion of the buckling body is sealed by a spacer layer, and an ink supply path is formed between the orifice plate and the other side edge portion of the buckling body, such that the gap defines a cavity; and a nozzle which is provided as an ink discharge outlet and located in a position of the orifice plate opposite to a center portion of the pressure generating structure.

18. A diaphragm type ink jet head as claimed in claim 17, wherein an area adjacent said ribbed portion is void of the buckling body.

19. A diaphragm type ink jet head as claimed in claim 17, wherein the buckling body is one of circular, pentagonal, hexagonal, octagonal, or square.

20. A diaphragm type ink jet head as claimed in claim 17, wherein the buckling body comprises a polygonal shape.

* * * * *